US011528575B2

(12) United States Patent
Del Sordo et al.

(10) Patent No.: US 11,528,575 B2
(45) Date of Patent: Dec. 13, 2022

(54) SYSTEM AND METHOD FOR DYNAMIC CONTROL OF WIRELESS SPEAKER SYSTEMS

(71) Applicant: ARRIS ENTERPRISES LLC, Suwanee, GA (US)

(72) Inventors: Christopher S. Del Sordo, Souderton, PA (US); Albert Fitzgerald Elcock, West Chester, PA (US); Charles R. Hardt, Lawrenceville, GA (US)

(73) Assignee: ARRIS ENTERPRISES LLC, Suwanee, GA (US)

( * ) Notice: Subject to any disclaimer, the term of this patent is extended or adjusted under 35 U.S.C. 154(b) by 0 days.

(21) Appl. No.: 17/361,728

(22) Filed: Jun. 29, 2021

(65) Prior Publication Data

US 2022/0038837 A1 Feb. 3, 2022

Related U.S. Application Data

(60) Provisional application No. 63/057,668, filed on Jul. 28, 2020.

(51) Int. Cl.
*H04S 7/00* (2006.01)

(52) U.S. Cl.
CPC ..... *H04S 7/302* (2013.01); *H04R 2420/07* (2013.01)

(58) Field of Classification Search
None
See application file for complete search history.

(56) References Cited

U.S. PATENT DOCUMENTS

| | | | | |
|---|---|---|---|---|
| 8,983,383 | B1 * | 3/2015 | Haskin | H04M 1/6041 455/556.1 |
| 10,409,549 | B2 * | 9/2019 | Lang | H04R 29/007 |
| 10,567,893 | B2 * | 2/2020 | Starobin | H04R 27/00 |
| 2008/0141316 | A1 | 6/2008 | Igoe et al. | |
| 2008/0165980 | A1 | 7/2008 | Pavlovic et al. | |
| 2008/0318518 | A1 | 12/2008 | Coutinho et al. | |
| 2015/0208188 | A1 | 7/2015 | Carlsson et al. | |
| 2015/0256954 | A1 | 9/2015 | Carlsson et al. | |
| 2016/0353218 | A1 * | 12/2016 | Starobin | G06F 3/167 |
| 2021/0105562 | A1 * | 4/2021 | Lombardi | H04L 12/2838 |

OTHER PUBLICATIONS

International Search Report and Written Opinion for Application No. PCT/US2021/039517 dated Sep. 30, 2021 (8 pages).

* cited by examiner

*Primary Examiner* — Paul W Huber
(74) *Attorney, Agent, or Firm* — Botos Churchill IP Law LLP

(57) ABSTRACT

A system and method for dynamically controlling multiple wireless speakers in response to the sensed location of one or more listeners and predefined audio preferences associated therewith. The position of a device associated with a given user is continuously monitored and the state of the wireless speakers adjusted accordingly so as to provide the user with a customized, yet consistent audio experience as they move with respect to the wireless speakers. Prioritization among multiple user devices is also provided for, thereby ensuring that higher-priority users are provided with the aural environment they have specified, or placing the wireless speaker system into an operational state that provides a suitable audio environment for all users.

18 Claims, 7 Drawing Sheets

SYSTEM AND METHOD FOR DYNAMIC CONTROL OF WIRELESS SPEAKER SYSTEMS

CROSS-REFERENCE TO RELATED APPLICATION

This application claims the benefit of U.S. Provisional Patent Application No. 63/057,668, filed Jul. 28, 2020, which is incorporated by reference herein in its entirety.

BACKGROUND OF THE INVENTION

The use of wireless speaker systems continues to grow. These systems enable users to wirelessly connect multiple speakers to a variety of entertainment and information systems. These systems can range from simple two-speaker stereo arrangements to much more complex multi-speaker systems, such as those associated with 5.1 and 7.2 surround sound systems typically associated with home theater applications. In addition, wireless speaker systems make distributing sound throughout multiple rooms of a residence, or to an adjacent yard or patio, quite easy. The wireless signals employed for transmitting audio to wireless speakers have a typical range of 150 feet (estimated indoor range of 2.4 GHz Wi-Fi) to over 400 feet (estimated outdoor range of Bluetooth® 5 LE). Consumer preferences may drive the need to increase the bass for example put out by a subwoofer, or the relative amount of treble produced by a given speaker.

As the number of speakers, the number of rooms or the physical breadth of a given wireless speaker system increases, it becomes ever more critical, and unfortunately more difficult, for a user to properly adjust speaker volume, equalization and balance as the user moves with respect to the various speakers.

For example, as shown in FIG. 1A, a user 102, situated within room 104 listens to an audio program via wireless speaker 106. When the user is in the position shown in FIG. 1A, in close proximity to speaker 106, assume user 102 perceives the sound from speaker 106 to be at an ideal volume level. If the user was then to move to the position shown in FIG. 1B, the sound from speaker 106 would become fainter, detracting from the audio experience. In order to keep the perceived volume level constant, the level of speaker 106 would have to be dynamically adjusted as a function of the user's position.

The adjustment of volume level becomes an even more complex matter when the wireless speaker system includes multiple speakers. FIG. 1C, a user 102, situated within room 108 listens to an audio program on a five-speaker wireless speaker system comprised of speakers 110*a*-110*e*. When the user is positioned in close proximity to speakers 110*a*, 110*b* and 110*c* (FIG. 1C), the sound from those three speakers would be more prominent than sound emanating from speakers 110*d* and 110*e* (assuming all five speakers are at approximately the same volume level). If the user was then to move to the position shown in FIG. 1D, the sound from speakers 110*d* and 110*e* would become most prominent. In order to keep the aural experience consistent as the user moved from the position shown in FIG. 1C to that shown in FIG. 1D, the volume levels of the five speakers would have to be dynamically adjusted based upon the user's position at any given time.

FIG. 1E depicts another environment wherein a wireless speaker system comprised of speakers 112*a*, 112*b*, 112*c* and 112*d* provides sound in rooms 114 and 116. In order to maintain a constant aural experience as user 102 moves from room 114 into room 116, the sound emanating from speakers 112*a* and 112*b* would have to adjusted to maintain the same balance between them as user 102 moved across room 114. As user 102 approached the entryway into room 116, speakers 112*c* and 112*d* would need to be activated and the sound levels adjusted accordingly as user 102 moved across room 112. Speakers 112*a* and 112*b* could then be lowered and ultimately muted as user 102 left room 114.

The system to control the volume, balance and other characteristics and capabilities of the wireless speaker system shown in FIGS. 1A-E, it simply is not practical for a user to continuously adjust volume and balance as he or she moves about or through a room. The burden of having to do so would certainly detract from experiencing or appreciating the particular audio being produced by the wireless speaker system.

Although the above discussion was focused primarily upon the volume and balance preferences and adjustments, the principles discussed are also applicable to other wireless speaker and wireless speaker system configuration parameters. These would include, but not be limited to speaker activation (number and type of speakers active); tone quality (bass, treble), etc.

While a user could theoretically adjust the volume and balance levels of a speaker or speakers within a wireless speaker system as he or she walked about within a room or traveled from one room to another (perhaps utilizing a wireless remote control unit), it is simply impractical to burden a user with that task. Having to continually makes such adjustments would almost certainly detract from the user's ability to experience or appreciate the particular audio being produced by the speakers. It would therefore be desirable to provide a system and method for automatically adjusting the absolute and relative levels of the sound produced by speakers within a wireless speaker system as a function of the user's position in relation to the speakers. In addition, it would be advantageous to provide for a system capable of configuring wireless speaker system capabilities and qualities based upon predetermined preferences associated with a particular identified user or users.

BRIEF SUMMARY OF THE INVENTION

A system and method for dynamically controlling multiple wireless speakers in response to the sensed location of one or more listeners and predefined audio preferences associated therewith. The position of a device associated with a given user is continuously monitored and the state of the wireless speakers adjusted accordingly so as to provide the user with a customized, yet consistent audio experience as they move with respect to the wireless speakers. Prioritization among multiple user devices is also provided for, thereby ensuring that higher-priority users are provided with the aural environment they have specified, or placing the wireless speaker system into an operational state that provides a suitable audio environment for all users.

BRIEF DESCRIPTION OF THE DRAWINGS

The aspects, and advantages of the present invention will become better understood with regard to the following description, appended claims, and accompanying drawings in which:

FIG. 1E is a functional block diagram of a system supporting a preferred embodiment of an automatic system for recording viewer reactions.

DETAILED DESCRIPTION

Figure 1B:
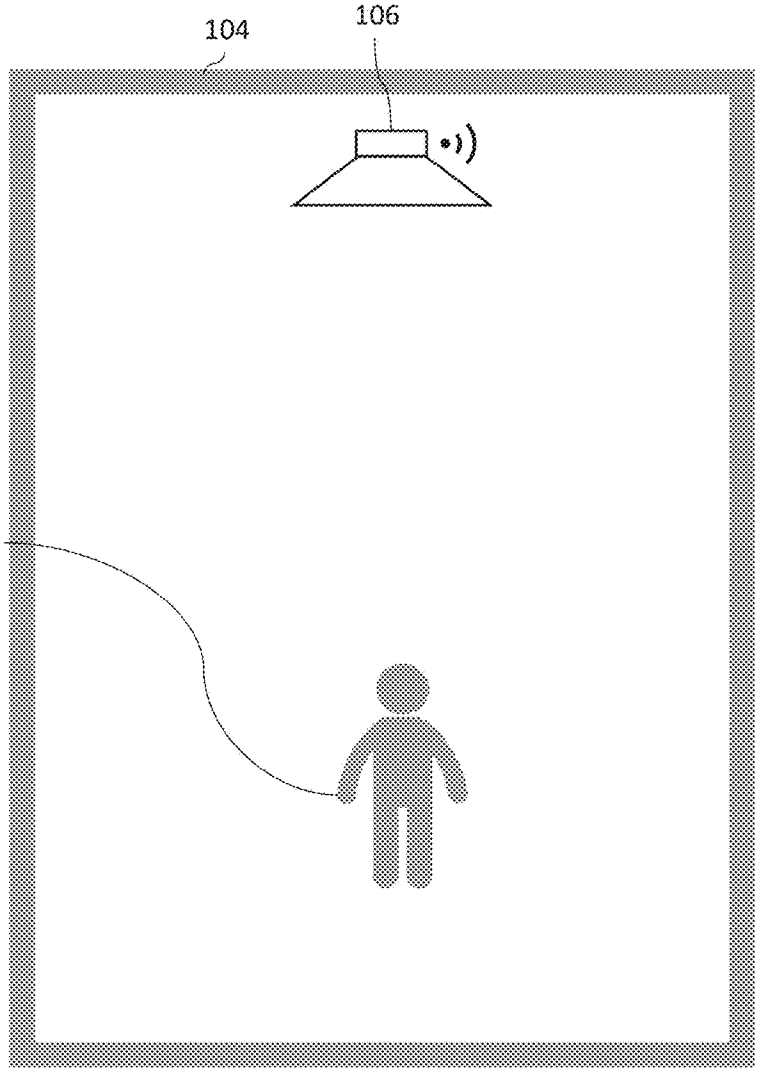
FIG. 1B is a functional block diagram of the single speaker system of FIG. 1A showing a user in a second position.
Figure 1A:
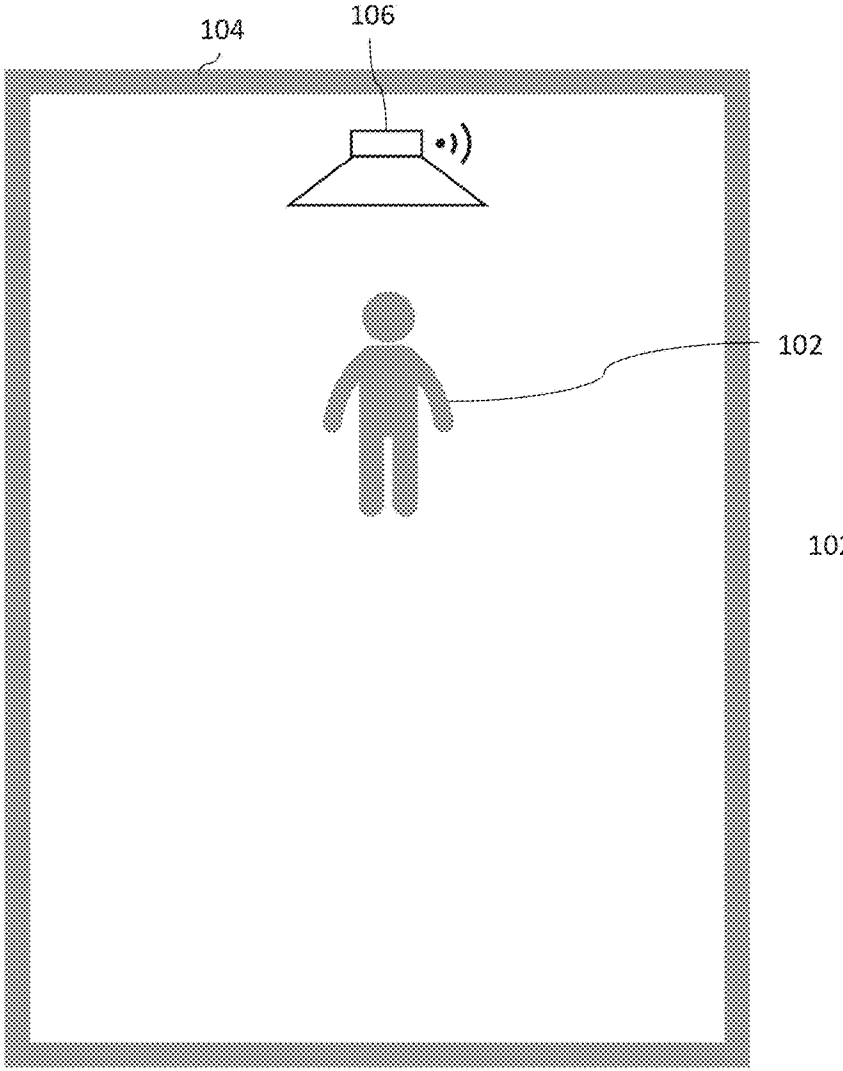
FIG. 1A is a functional block diagram of a single speaker system showing a user in a first position.
Figure 1D:
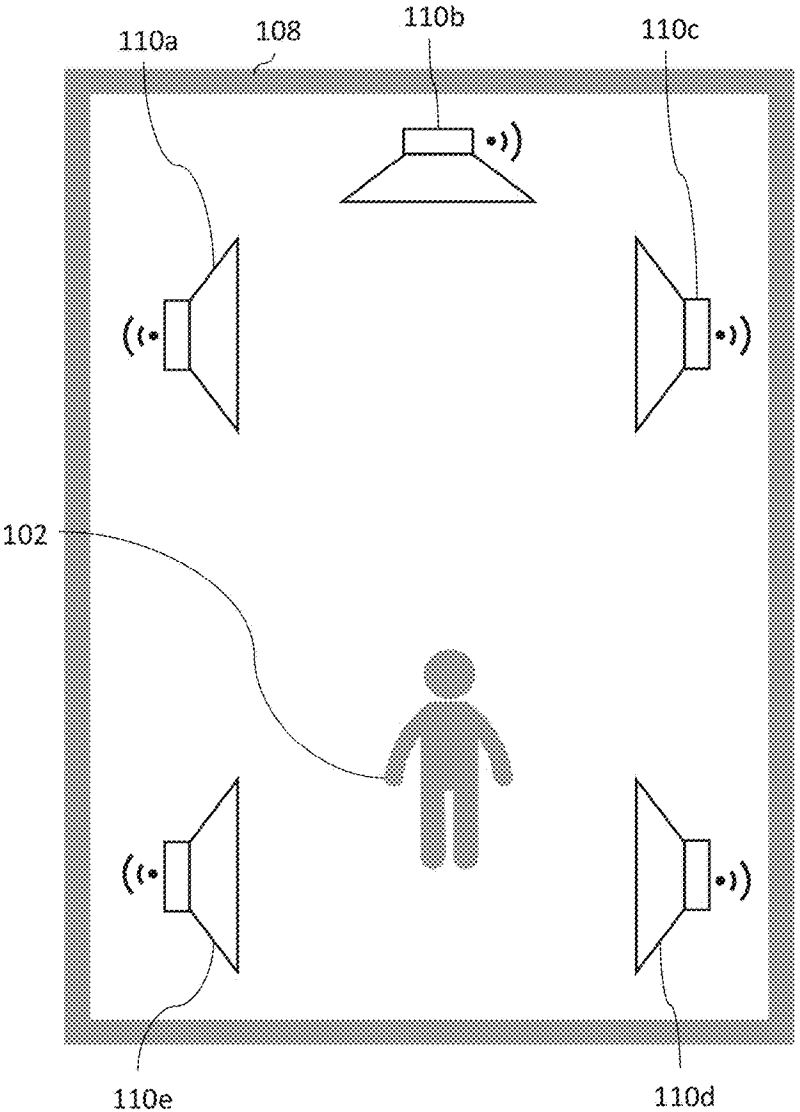
FIG. 1D is a functional block diagram of the five-speaker system of FIG. 1C showing a user in a second position.
Figure 1C:
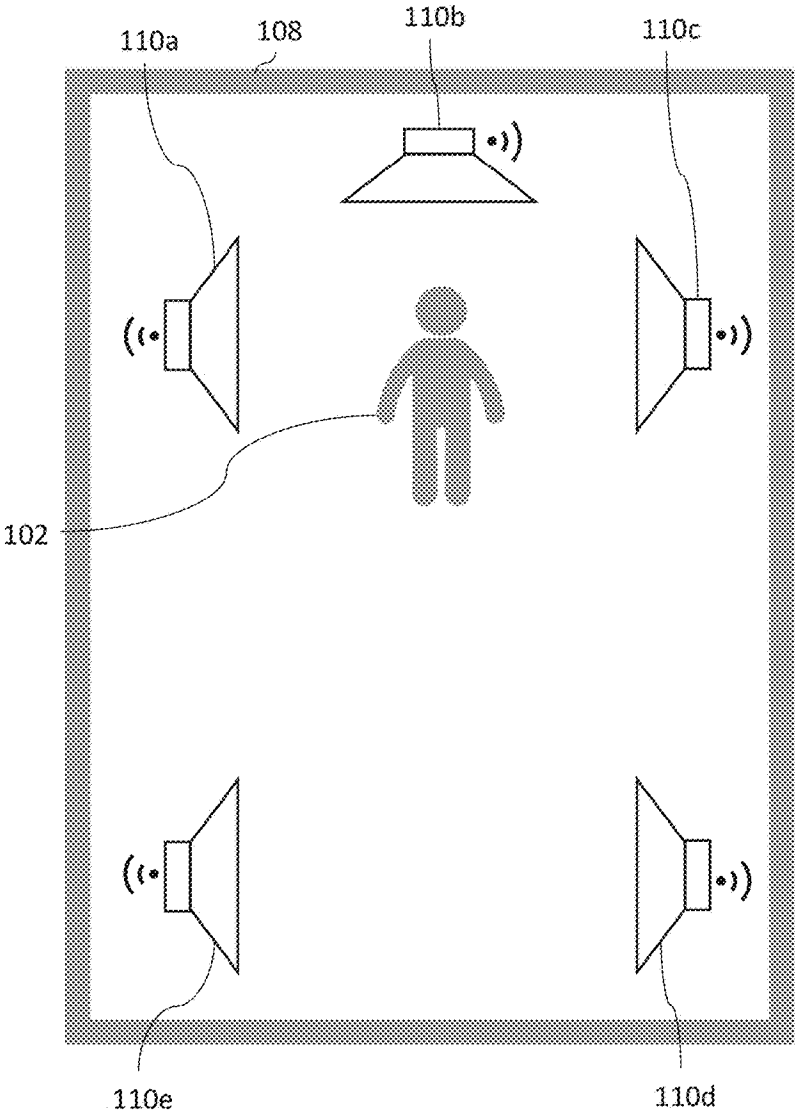
FIG. 1C is a functional block diagram of a five-speaker system showing a user in a first position.
Figure 1E:
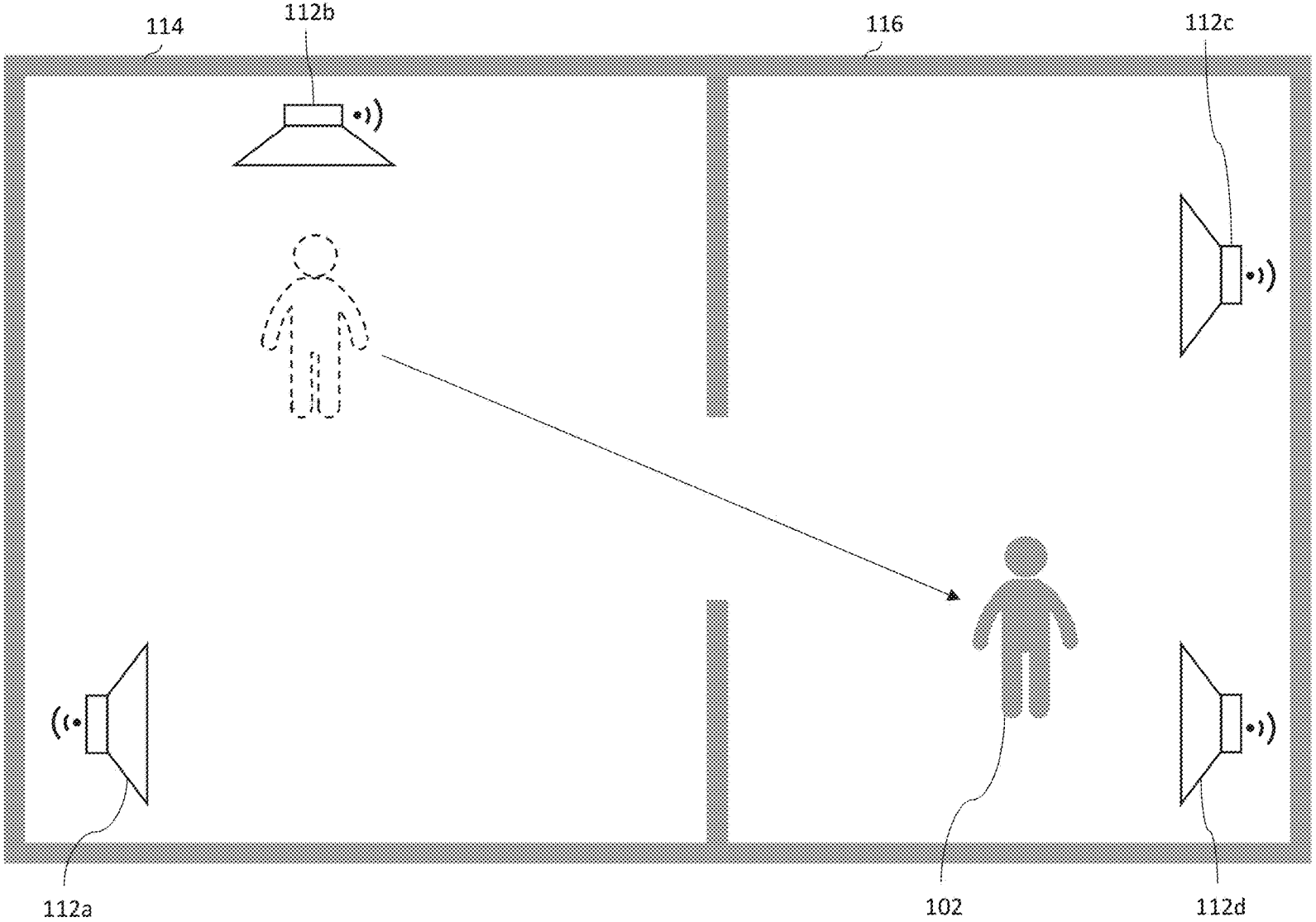
FIG. 1E is a functional block diagram of a four-speaker system depicting a user between a first room and a second room.
Figure 2:
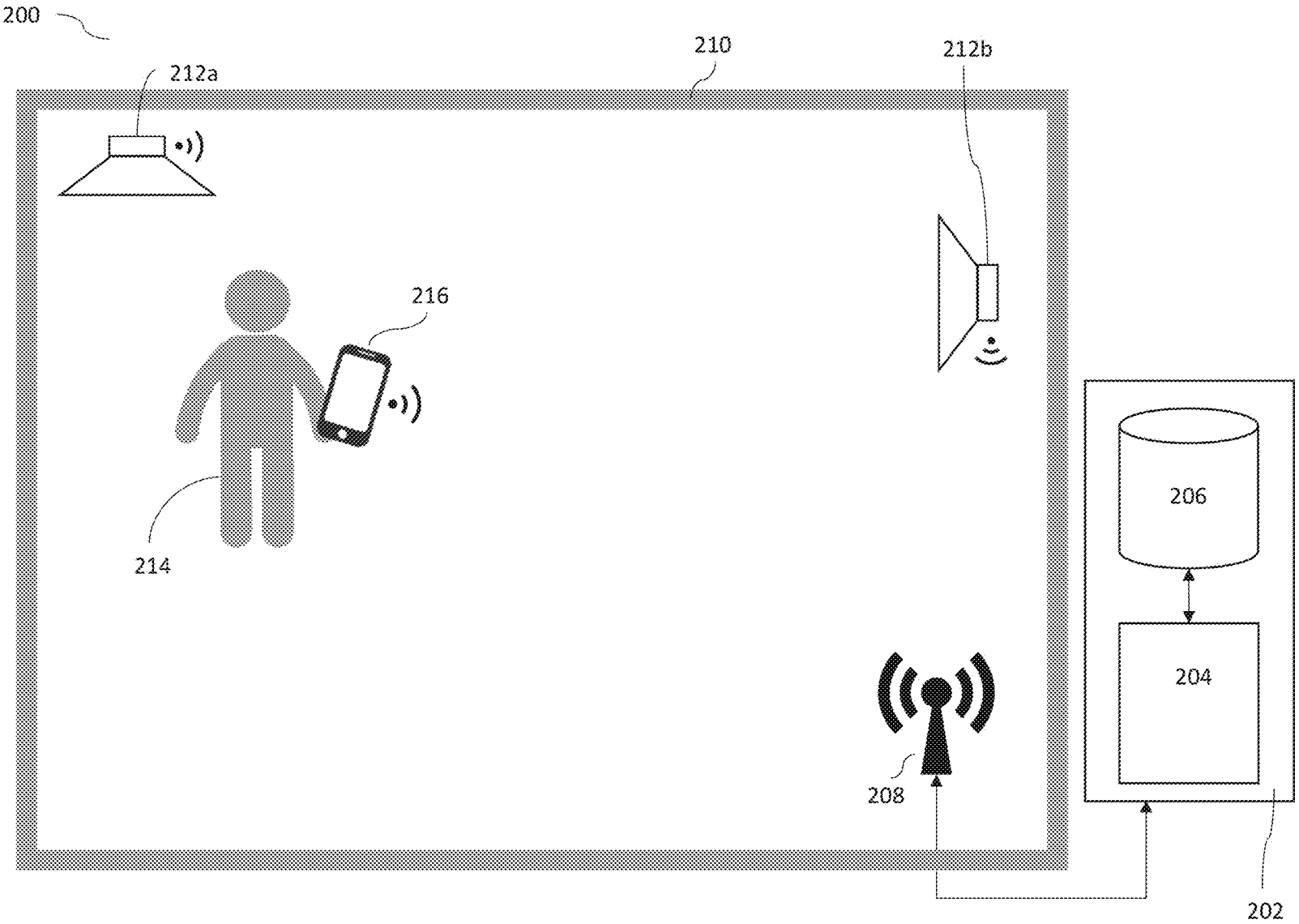
FIG. 2 is a functional block diagram of a first embodiment of a system for dynamically controlling a wireless speaker system.

FIG. 2 is a functional diagram of a preferred embodiment of a wireless speaker system (200) enabling automatic adjustment of the volume (both relative and absolute) of sound produced by speakers with the system. As shown, system 200 comprises smart media device ("SMD") 202 includes processor 204 and memory 206. SMD 202 is also shown to be linked to wireless transceivers 208 and 210. Wireless transceiver is positioned so as to ensure that signals broadcast from it propagate throughout room 210 and support digital communication between SMD 202 and wireless speakers 212*a* and 212*b*, for which SMD 202 serves as a controller. Wireless transceiver 208 can employ any wireless system and protocol compatible with wireless speakers 112*a* and 112*b* and capable of supporting the transmission of digital content (802.11 Wi-Fi and Bluetooth being examples of such). In addition, wireless transceiver 208 could comprise a single transceiver or multiple discrete transceivers.

Processor 204 is adapted to utilize transceiver 208 to provide speakers 212*a* and 212*b* with digital audio content. In addition, processor 204 also employs transceiver 208 to sense the location of compatible wireless devices within room 210. Numerous approaches for the indoor localization of radio-enabled devices are known in the art, including those relying upon one or more of the following: received radio signal strength ("RSS"), radio fingerprint mapping, angle of arrival sensing, time of flight measurements. The present state-of-the-art provides for employing these approaches, or combinations of these approaches, to permit device localization within Wi-Fi and/or Bluetooth wireless systems utilizing single or multiple transceiver arrangements.

Memory 206 stores data indicative of audio preferences associated with pre-registered wireless user devices. These devices include multipurpose smart devices, such as smartphones or tablets compatible with wireless transceiver 208, and dedicated devices, such as badges, wristbands or fobs adapted to communicate exclusively with system 200 via wireless transceiver 208. The identities of such devices, as well as associated audio preferences, would be stored in memory 206 by users or managers of system 200 via a user interface (not shown) linked to SMD 202. The audio preferences could include parameters defining audio conditions including, but not limited to:

- preferred perceived volume level;
- audio format preference (2 channel stereo, 5.1, 7.2, subwoofer on/off, etc.);
- dynamic volume adjustment on/off;
- dynamic balance equalization on/off;
- equalization profile; etc.

In addition, memory 206 also stores information indicative of the location of wireless speakers 212*a* and 212*b* within room 210. This speaker location information could have been previously entered into memory 206 via a user interface, or determined by processor 204 utilizing indoor localization techniques such as those discussed above.

Figure 3:
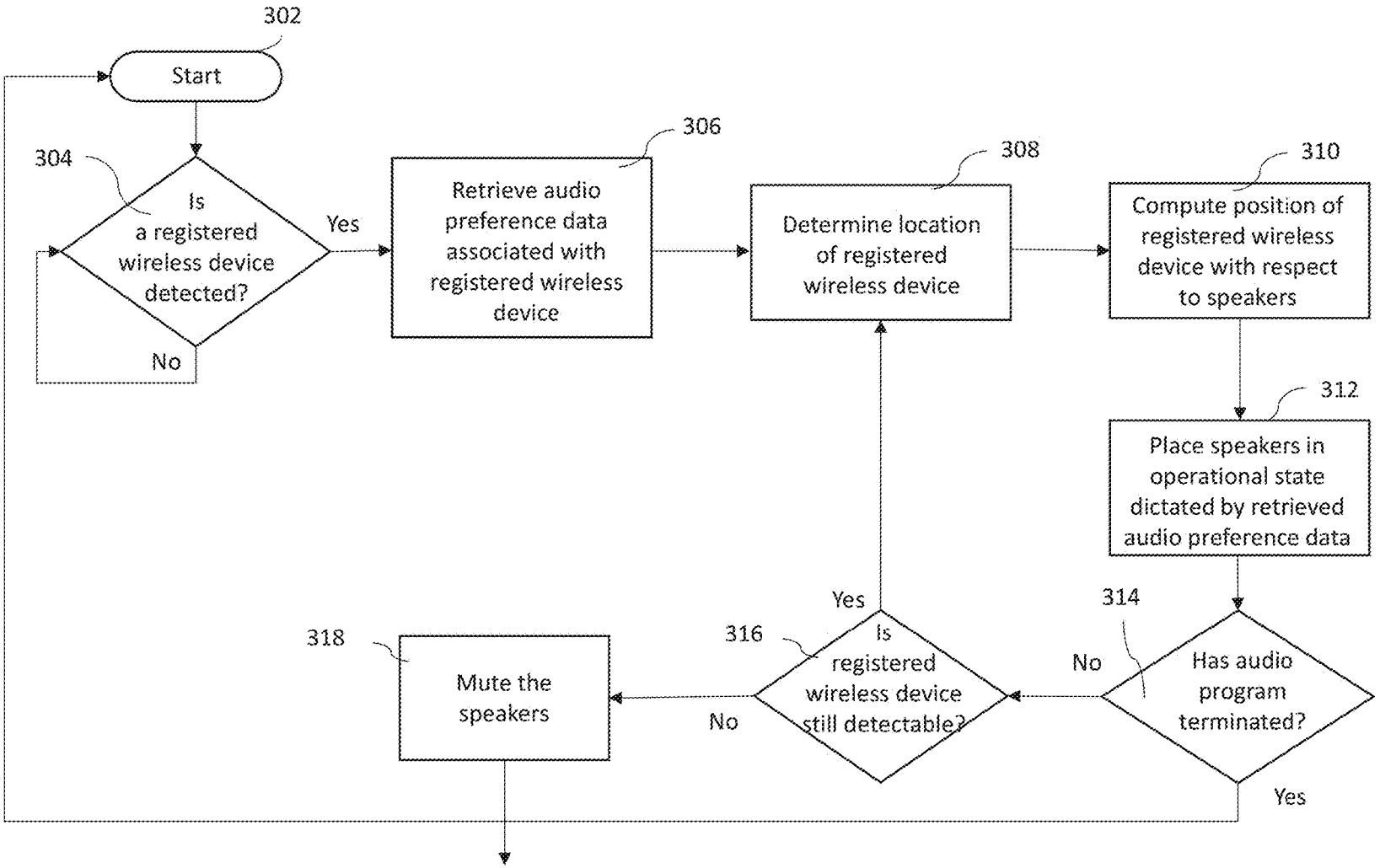
FIG. 3 is a process flow diagram of steps associated with implementing a first preferred embodiment of a system for dynamically controlling a wireless speaker system.

System 200 is adapted to support a device localization and audio control application, the process of which is illustrated in FIG. 3. In steps 302 and 304 processor 204 interrogates any wireless user devices detected in room 210 to determine if they constitute a registered device for which audio preferences are stored in memory 206. As shown in FIG. 2, user 214 is in possession of wireless user device 216. If processor 204 determines that wireless user device 216 is not a registered device (a negative outcome of step 304), the process loops and system 200 continues to look for registered devices. However, if wireless user device 216 is found to be a registered device, the process continues with step 306 and processor 204 obtains data indicative of the audio preferences associated with wireless user device 216 from memory 206.

Processor 204 also obtains data from wireless transceiver 208 (RSS, radio fingerprint mapping, angle of arrival sensing, time of flight measurements, etc.) and utilizes it to calculate the position of wireless user device 216 (step 308). In step 310, processor 204 then computes the relative position of wireless user device 216 with respect to each wireless speaker (212*a*, 212*b*). Processor 204 then causes wireless transceiver 208 to communicate commands to wireless speakers 212*a* and 212*b* so as to place them in an operational state dictated by the audio preference data (step 312). For example, based upon the calculated distance separating user device 216 (co-located with user 214) from speakers 212*a* and 212*b*, the volume level of the speakers will be adjusted to achieve user 214's desired perceived volume level. If user 214's stored audio preferences user 214 include activation of dynamic balance equalization, the volumes of speakers 212*a* and 212*b* will be adjusted relative to one another so that user 214 perceives them as being of equal volume.

Processor 214 then determines if the audio content being listened to by user 214 has terminated (step 312). If the content terminated (either because it has lapsed or because it was proactively terminated), the process continues with step 302 and the system attempts to detect a registered wireless device (step 304). If the audio content is continuing, processor 204 determines if the registered wireless device is still detectable (step 316). If the user has left the area being monitored by system 200 or has turned off their device off, the speakers are muted (step 318) the process continues with step 302 and the system attempts to detect a registered wireless device (step 304). Similarly, if the particular audio program being listened to by the user has terminated, the process continues with step 302 and the system attempts to detect a registered wireless device (step 304). However, if the audio content is still continuing, processor 204 determines the location of the registered wireless device (step 308). If the device's location has not changed, then there will be no alteration of the operational state of the speakers as a consequence of steps 310 and 312. If the device location has changed, then processor 204 will place the speakers in a new operational state as dictated by the audio preference data and the new user device location.

Figure 4:
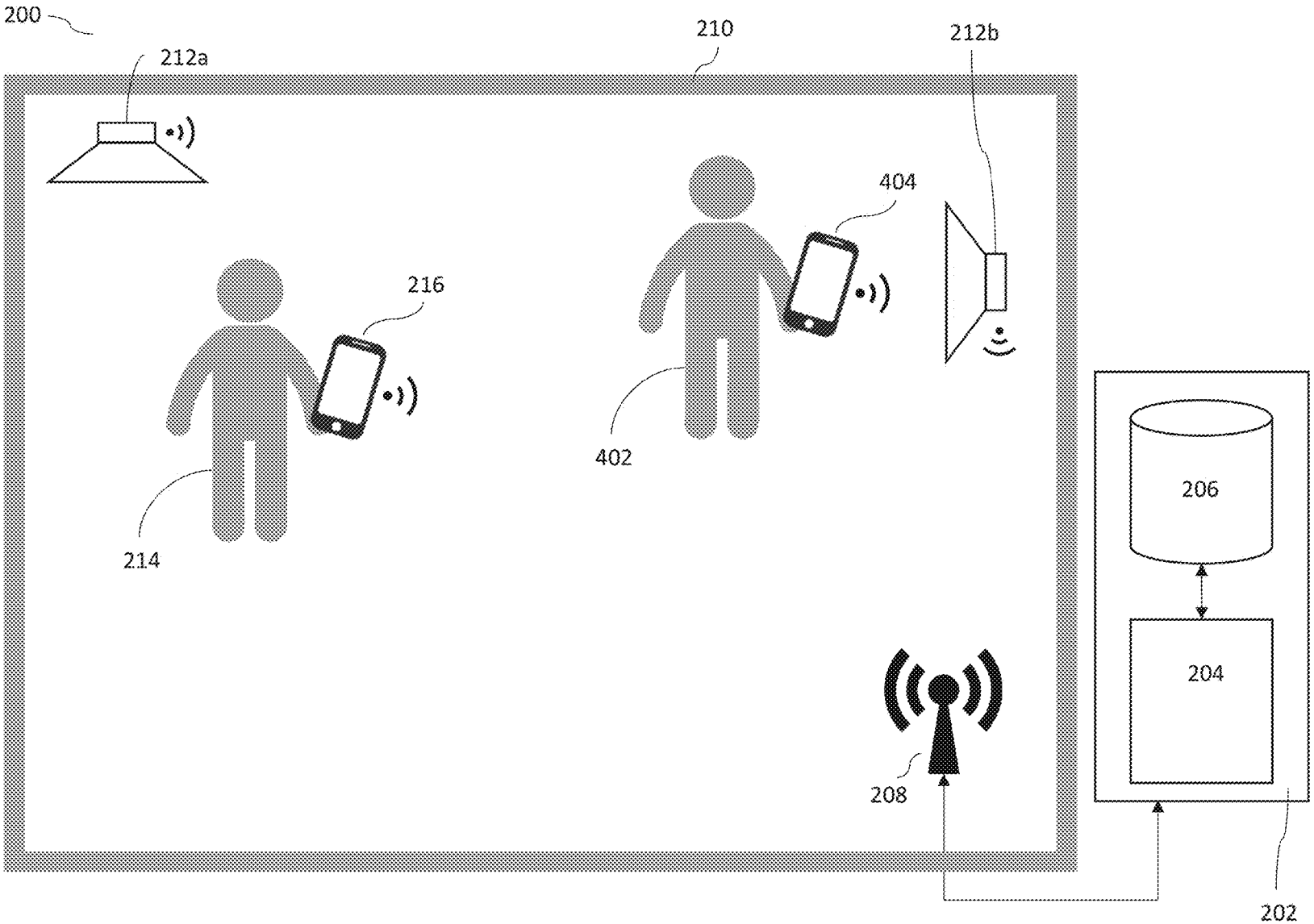
FIG. 4 is a functional block diagram of the system of FIG. 2 including multiple wireless user devices.

FIG. 4 shows an alternate embodiment of a system for the dynamic control of wireless speakers wherein multiple the registered wireless devices are present within a given environment serviced by an SMD. As shown, user 402 (in possession of registered wireless user device 404) has entered room 210. When more than one registered wireless device is determined to be within the environment served by SMD 202 (namely, room 210), processor 204 accesses multiple user prioritization information stored in memory 206. This prioritization information enables a process under which the operational state of speakers 212*a* and 212*b* should be adjusted to:

a) give a user associated with one detected registered user device priority over other users; or b) provide an aural environment based on the multiple user audio preferences; or c) place the speakers into a default operational mode.

Figure 5:
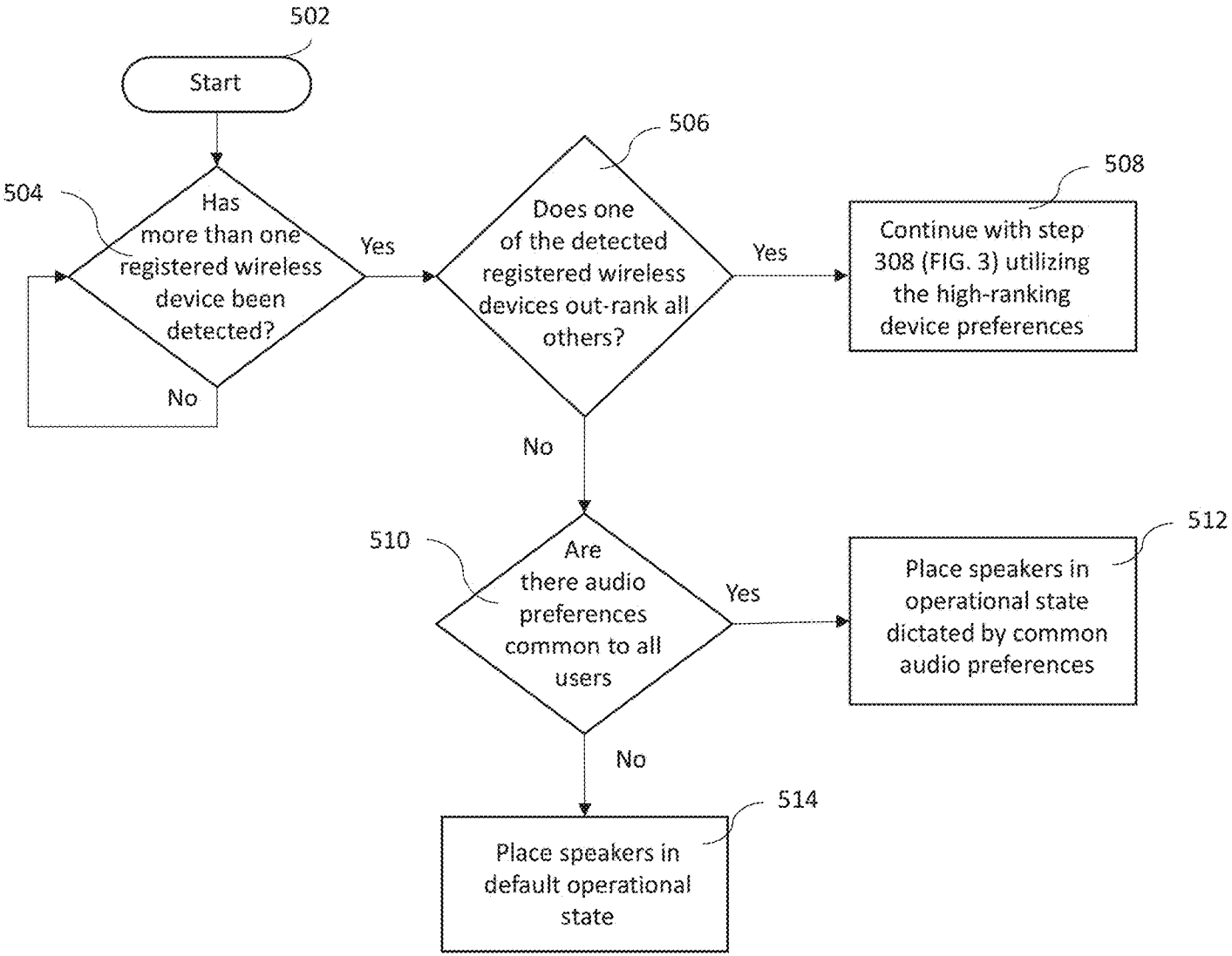
FIG. 5 is a process flow diagram of steps associated with implementing a second preferred embodiment of a system for dynamically controlling a wireless speaker system.

FIG. 5 provides a flow diagram depicting a particular process for responding to multiple registered user devices being in a given SMD environment. Upon determining that more than one registered user device has been detected (steps 502 and 504), processor 204 queries memory 206 for user device priority information. If this information shows one of the detected devices to have a higher priority than the other detected devices, then the audio preferences associated with that high-priority device will be utilized in determining the operational state of the speakers. For example, assume that SMD 202 had adjusted the operational state of speakers 212*a* and 212*b* in accordance with the audio preferences associated with registered wireless user device 216 in the possession of user 214. When user 402 entered room 210 with registered user device 404, processor 204 referenced information within memory 206 and determined that wireless user device 404 outranked device 216 (step 506). Processor 204 then adjusted the operational state of speakers 212*a* and *b* in accordance with the audio preferences associated with wireless user device 404 (step 508).

Contrastingly, if the information within memory 206 revealed that registered wireless user devices 216 and 404 have the same priority, processor 204 would determine what, if any, commonalities existed between the audio preferences set associated with wireless user device 216 and that associated with wireless user device 404 (step 510). Obviously, any preferences related to balancing volume between speakers would be impossible to reconcile between the two user preference files unless it was determined that the users were essentially in the same spot, of if they were positioned at points that placed them at similar distances from all the speakers. However, if the users had similar preferences for equalization, or overall volume level, these common preferences would be utilized to define the operational state of speakers 212*a* and 212*b* (step 512). All other audio parameters associated with the operational state of the speakers would be returned to a default setting. This default setting, stored in memory 206, could be predetermined by an SMD provider (such a multi-service operator or MSO), or defined by user input via a user interface.

In the situation where no commonality is found between the audio preferences of similarly prioritized registered wireless user devices, the process continues with step 514 and speakers 212*a* and 212*b* are placed into a default operational state.

Although the above described embodiment dealt with only a single room, and two speakers, the concepts can be applied to multi-room or interior/exterior speaker arrangements utilizing any number of wireless speakers. The location of each speaker being stored in memory 206 (either as a consequence of user input, or due to the system sensing the speaker locations). As the system senses the registered wireless device moving through, between or out of the rooms, the operational state of each of the wireless speakers would be adjusted accordingly.

It should also be understood that the process by which the user's location, as well as the location of the wireless speakers, is not limited to a process utilizing RSS, radio fingerprint mapping, angle of arrival sensing, time of flight measurements, or RF signals in general. The localization processes could be accomplished via or augmented with data obtained via sonic or ultrasonic sensing utilizing one or more transducers (which could be linked to system 200 via wired or wireless means).

Although the invention herein has been described with reference to particular embodiments, it is to be understood that these embodiments are merely illustrative of the principles and applications of the present invention. For example, the processor and/or memory associated with a given SMD could be located external to the SMD, including in a cloud or networked environment. In addition, the SMD can be a stand-alone device, such as a set-top box or audio amplifier, or the SMD could be integrated into another system or device such as a television, a digital assistant, smartphone, tablet or a computer. All of the above variations and extensions could be implemented and practiced without departing from the spirit and scope of the present invention as defined by the appended claims.

The invention claimed is:

1. A system for controlling a plurality of wireless speakers, the system comprising:

a plurality of wireless speakers;

at least two wireless user devices;

at least one media controller, comprising at least one processor and at least one memory, wherein the memory is adapted to store audio preference data associated with each of the at least two wireless user devices; and at least one wireless network linking the at least one media controller, the at least two wireless user devices, and the plurality of wireless speakers;

wherein the at least one processor is adapted to:

determine the location of each of the at least two wireless user devices based, at least in part, upon information received via the at least one wireless network;

retrieve from the at least one memory audio preference data associated with each of the at least two wireless user devices;

retrieve from the at least one memory information indicative of the relative priority of the at least two wireless user devices;

determine, based upon the retrieved relative priority information, that the at least two wireless user devices have the same priority;

identify commonalities among the audio preference data associated with each of the at least two wireless user devices having the same priority; and adjust the operational state of the plurality of wireless speakers based, at least in part, on the determined location of each of the at least two wireless user devices and the identified commonalities.

2. The system of claim 1 wherein the controller comprises at least one of the following:
a set-top box;
a television;
a computer;
a smart phone;
a tablet;
an audio amplifier; and
a digital assistant.

3. The system of claim 1 wherein the audio preference data comprises at least one of the following:
preferred perceived volume level;
audio format preference;
dynamic volume adjustment;
dynamic balance equalization; and
equalization profile.

4. The system of claim 1 wherein the at least two wireless user devices comprise at least one of the following:
a smart phone;
a tablet;
a wristband;
a badge; and
a fob.

5. The system of claim 1 wherein the at plurality of wireless speakers are collocated within the same room.

6. The system of claim 1 wherein the at plurality of wireless speakers are located across multiple rooms.

7. The system of claim 1 wherein the adjustment of the operational state of the plurality of wireless speakers comprises muting of at least one wireless speaker.

8. The system of claim 1 wherein determining the location of each of the at least two wireless user devices is based, at least in part, on at least one of the following:
received radio signal strength,
radio fingerprint mapping,
angle of arrival sensing, and
time of flight measurements;
sonic sensing; and
ultrasonic sensing.

9. The system of claim 1 wherein the identified commonalities are found to be zero, and based at least in part upon the determination of zero commonalities, the at least one processor is further adapted to adjust the operational state of the plurality of wireless speakers to a default state.

10. A method for controlling a plurality of wireless speakers in a system comprising:
a plurality of wireless speakers;
at least two wireless user devices;
at least one media controller, comprising at least one processor and at least one memory, wherein the memory is adapted to store audio preference data associated with each of the at least two wireless user devices; and
at least one wireless network linking the at least one media controller, the at least two wireless user devices, and the plurality of wireless speakers;
the method comprising the steps of:
determining the location of each of the at least two wireless user devices based, at least in part, upon information received via the at least one wireless network;
retrieving from the at least one memory audio preference data associated with each of the at least two wireless user devices;
retrieving from the at least one memory information indicative of the relative priority of the at least two wireless user devices;
identifying commonalities among the audio preference data associated with the at least two wireless user devices; and
adjusting the operational state of the plurality of wireless speakers based, at least in part, on the determined location of each of the at least two wireless user devices and identified commonalities.

11. The method of claim 10 wherein the controller comprises at least one of the following:
a set-top box;
a television;
a computer;
a smart phone;
a tablet;
an audio amplifier; and
a digital assistant.

12. The method of claim 10 wherein the audio preference data comprises at least one of the following:
preferred perceived volume level;
audio format preference;
dynamic volume adjustment;
dynamic balance equalization; and
equalization profile.

13. The method of claim 10 wherein the at least two wireless user devices comprises at least one of the following:
a smart phone;
a tablet;
a wristband;
a badge; and
a fob.

14. The method of claim 10 wherein the at plurality of wireless speakers are collocated within the same room.

15. The method of claim 10 wherein the at plurality of wireless speakers are located across multiple rooms.

16. The method of claim 10 wherein the adjustment of the operational state of the plurality of wireless speakers comprises muting of at least one wireless speaker.

17. The method of claim 10 wherein determining the location each of the at least two wireless user devices is based, at least in part, on at least one of the following:
received radio signal strength,
radio fingerprint mapping,
angle of arrival sensing, and
time of flight measurements;
sonic sensing; and
ultrasonic sensing.

18. The method of claim 10 wherein the wherein the identified commonalities are found to be zero, and based at least in part upon the determination of zero commonalities, the step of adjusting the operational state of the plurality of wireless speakers comprises placing the plurality of wireless speakers into a default state.

* * * * *